US007775145B2

(12) United States Patent
Bitar et al.

(10) Patent No.: US 7,775,145 B2
(45) Date of Patent: Aug. 17, 2010

(54) SYSTEM FOR NEUTRALIZING EXPLOSIVE AND ELECTRONIC DEVICES

(75) Inventors: Peter Victor Bitar, Anderson, IN (US); Ricky Lee Busby, Anderson, IN (US)

(73) Assignee: Xtreme ADS Limited, Anderson, IN (US)

( * ) Notice: Subject to any disclaimer, the term of this patent is extended or adjusted under 35 U.S.C. 154(b) by 492 days.

(21) Appl. No.: 11/832,952

(22) Filed: Aug. 2, 2007

(65) Prior Publication Data

US 2008/0028921 A1 Feb. 7, 2008

Related U.S. Application Data

(60) Provisional application No. 60/821,154, filed on Aug. 2, 2006.

(51) Int. Cl.
*F42B 33/06* (2006.01)

(52) U.S. Cl. ..... 89/1.13; 102/403; 86/50

(58) Field of Classification Search ..... 89/1.13; 102/402–403; 86/50
See application file for complete search history.

(56) References Cited

U.S. PATENT DOCUMENTS

| | | | | |
|---|---|---|---|---|
| 2,974,216 | A * | 3/1961 | Inoue | 219/69.12 |
| 3,601,054 | A | 8/1971 | Christianson | |
| 3,663,787 | A | 5/1972 | Haswell, III et al. | |
| 3,905,272 | A | 9/1975 | Johnson | |
| 4,148,321 | A | 4/1979 | Wyss et al. | |
| 4,401,875 | A * | 8/1983 | Schlienger et al. | 219/69.2 |
| 4,793,325 | A | 12/1988 | Cadossi et al. | |
| 4,911,686 | A | 3/1990 | Thaler | |
| 4,961,181 | A * | 10/1990 | Elliott | 367/142 |
| 5,001,485 | A * | 3/1991 | Jones | 342/13 |
| 5,007,346 | A * | 4/1991 | Kirkland | 102/402 |
| 5,063,850 | A * | 11/1991 | Olsson et al. | 102/402 |
| 5,079,482 | A * | 1/1992 | Villecco et al. | 315/111.81 |
| 5,108,247 | A | 4/1992 | Vlaanderen | |
| 5,323,726 | A * | 6/1994 | Olsson | 114/221 R |
| 5,668,342 | A | 9/1997 | Discher | |
| 5,675,103 | A | 10/1997 | Herr | |
| 5,908,444 | A | 6/1999 | Azure | |
| 5,935,460 | A * | 8/1999 | Mori et al. | 219/121.59 |
| 6,163,242 | A * | 12/2000 | Crewson et al. | 336/147 |
| 6,254,764 | B1 | 7/2001 | Babington et al. | |
| 6,486,577 | B1 | 11/2002 | Ursel et al. | |
| 6,606,932 | B2 * | 8/2003 | Goldstein | 89/1.13 |
| 6,749,389 | B1 | 6/2004 | Vlaanderen | |
| 6,799,499 | B2 * | 10/2004 | Seregelyi et al. | 89/1.13 |
| 6,822,250 | B2 | 11/2004 | Korenev | |

(Continued)

FOREIGN PATENT DOCUMENTS

| | | | |
|---|---|---|---|
| GB | 2122553 | A | 1/1984 |

*Primary Examiner*—Michael Carone
*Assistant Examiner*—Michael D David
(74) *Attorney, Agent, or Firm*—Woodard, Emhardt, Moriarty, McNett & Henry LLP

(57) ABSTRACT

A system for executing a method for neutralizing an explosive device disposed within a targeted area. In operation, an artificial lightning generator of the system generates one or more electric sparks. Additionally, a spinning breakout apparatus of the system spins a spark emission point in a predetermined pattern within the targeted area, and for neutralizing the explosive device, discharges the electric spark(s) into the targeted area via the spark emission point.

20 Claims, 4 Drawing Sheets

U.S. PATENT DOCUMENTS

| | | | | |
|---|---|---|---|---|
| 6,825,792 | B1 | 11/2004 | Letovsky | |
| 7,051,636 | B1 | 5/2006 | Snow et al. | |
| 7,130,624 | B1 | 10/2006 | Jackson et al. | |
| 7,296,503 | B1 * | 11/2007 | McGrath | 89/1.13 |
| 2004/0200341 | A1 | 10/2004 | Walters et al. | |
| 2006/0278069 | A1 | 12/2006 | Ryan | |
| 2008/0156219 | A1 * | 7/2008 | Voss et al. | 102/402 |

* cited by examiner

SYSTEM FOR NEUTRALIZING EXPLOSIVE AND ELECTRONIC DEVICES

CROSS-REFERENCE TO RELATED APPLICATIONS

The present application claims priority to the previously filed provisional application U.S. Patent Application No. 60/821,154 filed Aug. 2, 2006, which is hereby incorporated by reference.

TECHNICAL FIELD OF THE PRESENT INVENTION

The present disclosure generally relates to weapons and, more particularly, to a resonance transformer-based, artificial lightning generator which targets explosive devices to neutralize or detonate them, utilizing a spinning emission point to direct the spark output.

BACKGROUND OF THE PRESENT INVENTION

Improvised explosive devices ("IEDs") are bombs constructed in an improvised manner that are designed to cause death or injury by using any available explosives and any available initiation system for igniting the explosives. The primary types of IEDs are (1) command-wire IEDs, (2) remote detonated IEDs, (3) vehicle borne IEDs ("VBIEDs") and (4) pressure plated IEDs. Command-wire IEDs typically employ a detonation switch (e.g., a garage door opener or a timer) at one end of a command wire and the explosives at an opposite end of the command wire. Remote detonated IEDs are initiated by a transmitter (e.g., as a cordless phone or hand-held radio). A VBIED is a car or truck bomb employed by a suicide bomber or remotely controlled.

The basic forms of IED initiation systems are electric based systems and non-electric based systems. Examples of electric based IED initiation systems are (1) remote controlled radio frequency ("RF"), infrared ("IR") or laser signaling systems, (2) active IR or laser "trip wire" systems, (3) passive IR systems and (4) command-wire systems.

Currently, detection and neutralization technologies for IEDs are not capable of simultaneously targeting multiple IED initiation methods and therefore are only partially effective.

For example, RF jamming equipment (e.g., IED Countermeasures Equipment and the Warlock) is only effective with blocking RF initiated IEDs and does not eliminate (e.g., destroy or detonate) the threat. These systems also can be partially effective because they must be set to operate within the correct frequency range in order to stop an IED in view of the fact that much of the RF spectrum is un-managed and can sometimes cause dangerous interference with radio communications.

By further example, very short range, pulsed high-frequency, high-power electromagnetic energy system (e.g., Neutralizing Improvised Explosive Devices with Radio Frequency) is only effective against electronic initiated IEDs.

Additionally, high powered lasers are only effective once an IED has been visually detected and identified. However, visual detection and identification of IEDs, such as, for example, by remote unmanned reconnaissance drones fitted with cameras, binoculars, or other visual enhancement technologies, can be inefficient in detecting hidden or camouflaged IEDs.

Those skilled in the art are therefore continually striving to improve upon existing techniques for neutralizing an explosive device.

SUMMARY OF THE PRESENT INVENTION

The present invention provides new and unique systems and methods for neutralizing an explosive device (e.g., IED, a landmine, etc.) disposed within a targeted area. For purposes of the present invention, the phrase "neutralizing an explosive device" is broadly defined herein as any act or acts for rendering an explosive inoperable including, but not limited to, (1) disabling, defusing, deactivating or otherwise passively neutralizing an explosive device and/or its associated electronics for controlling the explosive device, and (2) detonating, destroying or otherwise destructively neutralizing the explosive device and/or its associated electronics for controlling the explosive device, particularly in a controlled manner.

In a first form, a method of the present invention implements a generation of one or more electric sparks, a spinning of a spark emission point in a predetermined pattern within the targeted area, and for neutralizing the explosive device, a discharging of the electric spark(s) into the targeted area via the spinning spark emission point.

In a second form, a system of the present invention employs an artificial lightning generator and a spinning breakout apparatus. In operation, the artificial lightning generator generates one or more electric sparks, and for neutralizing the explosive device, the spinning breakout apparatus spins the spark emission point in a predetermined pattern within the targeted area and discharges the electric spark(s) into the targeted area via the spinning spark emission point.

The aforementioned forms and other forms as well as objects and advantages of the present invention will become further apparent from the following detailed description of various embodiments of the present invention read in conjunction with the accompanying drawings. The detailed description and drawings of the various embodiments of the present invention are merely illustrative of the present invention rather than limiting, the scope of the present invention being defined by the appended claims and equivalents thereof.

DETAILED DESCRIPTION OF THE PRESENT INVENTION

Figure 1:
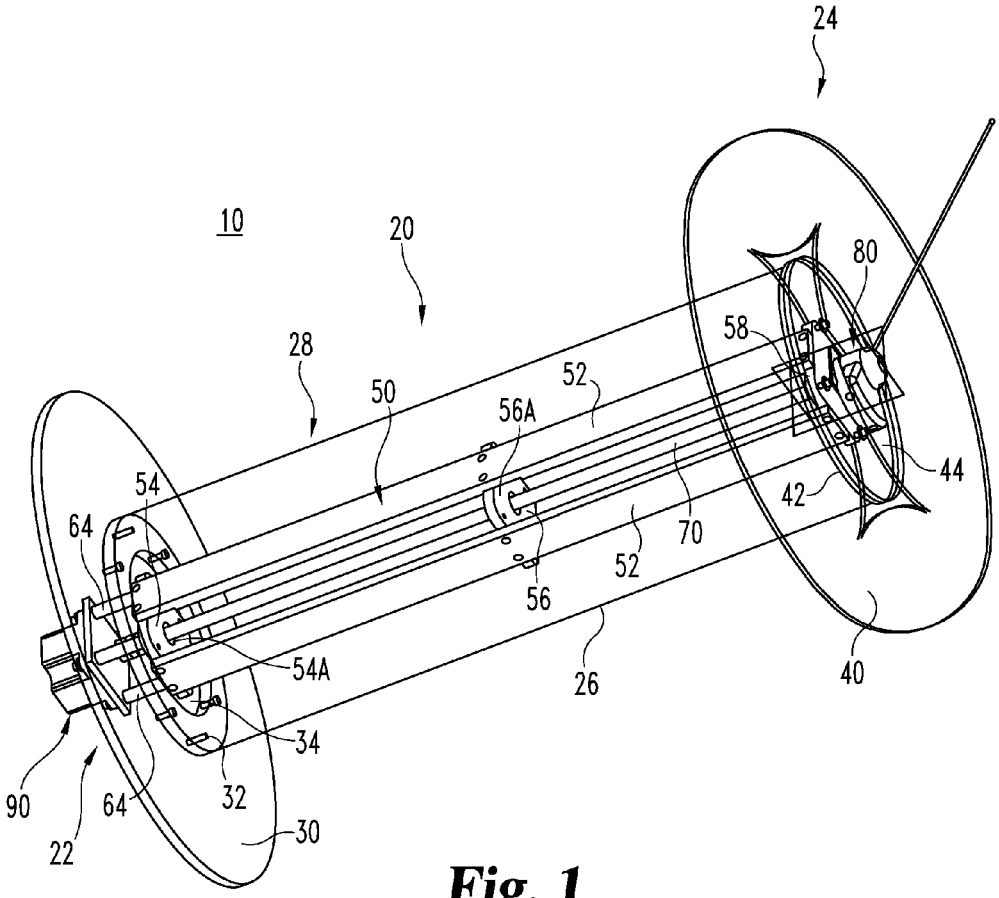
FIG. 1 illustrates an exemplary embodiment in accordance with the present invention of a resonance transformer having a rotating electrode.

For the purposes of promoting an understanding of the principles of the present invention, reference will now be made to various exemplary embodiments illustrated in the drawings and specific language will be used to describe the same. It will nevertheless be understood that no limitation of the scope of the present invention is thereby intended, and alterations and modifications in the illustrated device, and further applications of the principles of the disclosure as illustrated therein are herein contemplated as would normally occur to one skilled in the art to which the disclosure relates.

Figure 2:
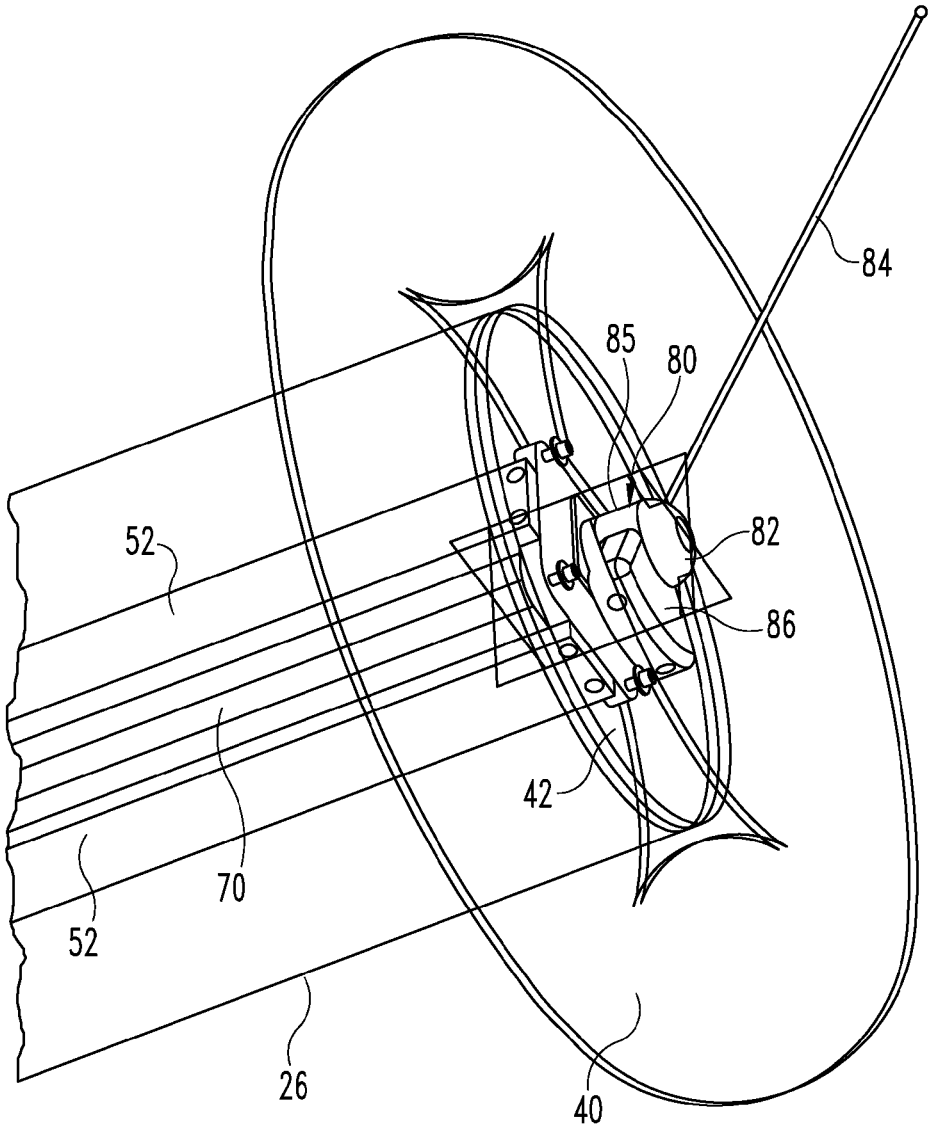
FIG. 2 illustrates a detailed view of a first portion of the transformer shown in FIG. 1, particularly showing a rotating electrode having a breakout point lead to emit spark discharge of high voltage energy.
Figure 3:
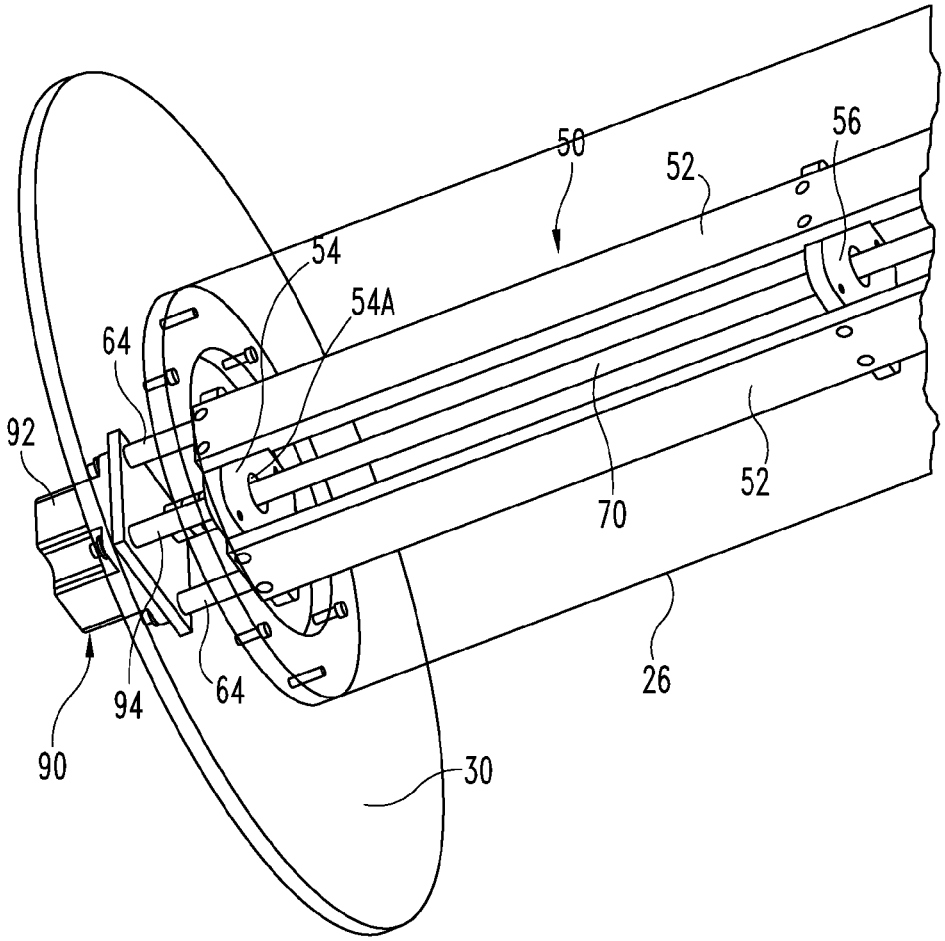
FIG. 3 illustrates a detailed view of a second portion of the transformer shown in FIG. 1, particularly showing a coil assembly and rotating electrode attachment point.

Please note that components in FIGS. 1-3 are shown as being transparent only for purposes of facilitating an understanding of the description of FIGS. 1-3.

As shown in FIGS. 1-4, an explosive and electronics neutralizing system 10, described herein, illustratively incorporates a resonance transformer, or any other form of "artificial lightning" producing device, coupled to an apparatus which spins a "break-out" or discharge point at the end of an electrode in order to discharge high voltage energy, in the form of a spark, into a targeted area. A motor causes the electrode to sweep through a circular pattern, which when moved (such as if attached to a vehicle or other moving platform) forms an overlapping pattern to cover an area suspected of concealing explosive devices. The electrical discharge acts to neutralize the explosive device.

Illustratively, system 10 may comprise a Tesla Coil, Odin Coil, or any other form of resonance transformer to control and direct the energy discharged to at least one discharge point to produce a desired spark pattern on the ground, which provides maximum desired coverage when sweeping for an explosive device.

Figure 4:
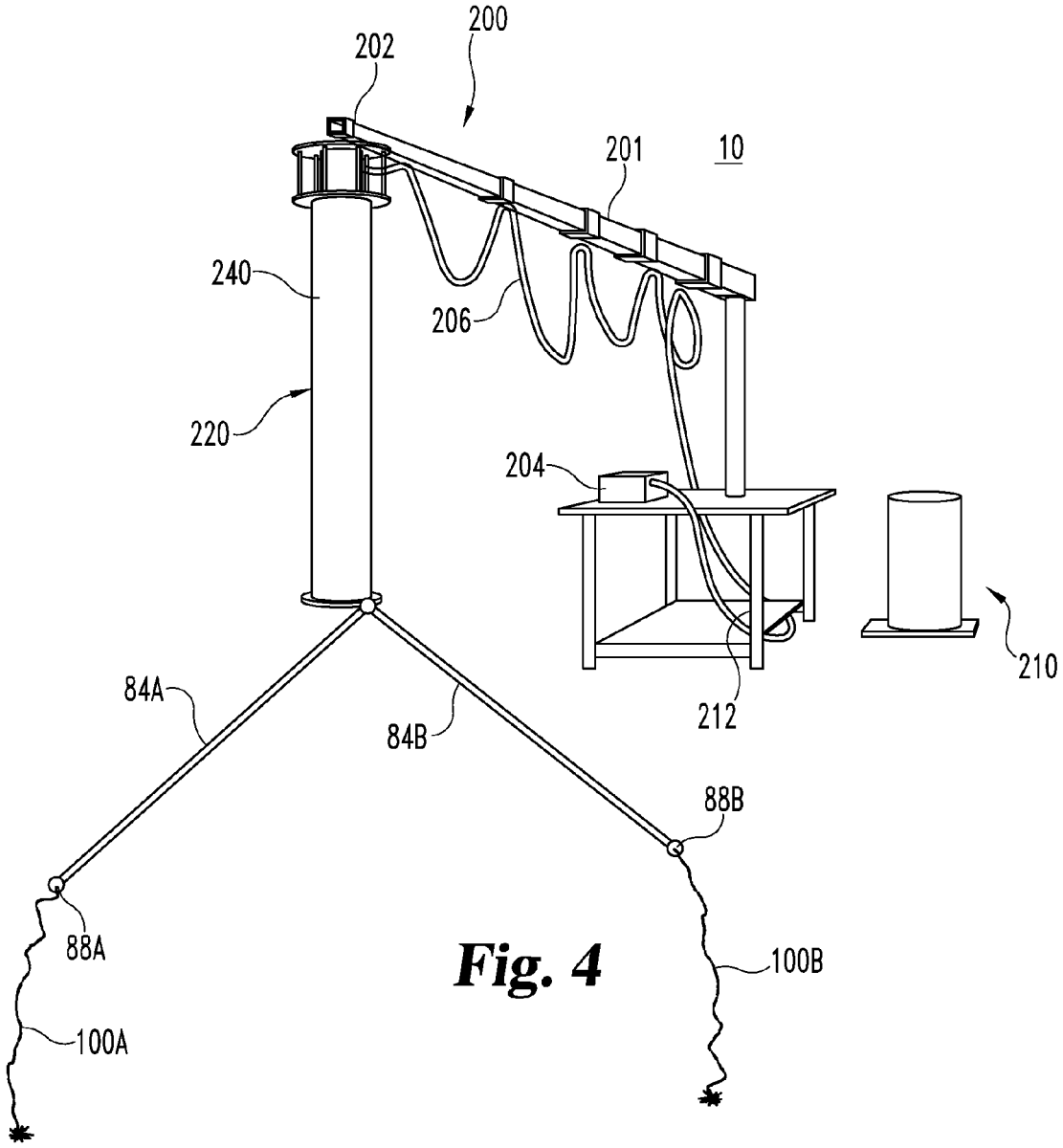
FIG. 4 illustrates an exemplary embodiment in accordance with the present invention of a boom system for deploying a resonant transformer coil assembly and rotating electrode.

As shown in FIG. 1, system 10 includes an a resonance transformer assembly 20 comprising a distal end 22 and a proximal end 24, operably coupled by core 26 to form a bobbin 28 for receiving coil windings (shown as windings 240 in FIG. 4). Primary and secondary coils (not shown) of transformer assembly 20 are wound about hollow cylindrical core 26 of bobbin 28. Proximal end 24 includes a movable, e.g., spinning, breakout assembly point 80 that attaches to motor assembly 90 at distal end 22 via rod 70.

Distal end 22 includes bobbin plate 30 having bobbin mounting ring 32 and bobbin plate cutout 34. End 24 includes bobbin plate 40 having mounting ring 42 and bobbin plate cutout 44. Bobbin 28 is formed by attaching bobbin plate 30 at bobbin mounting ring 32 and bobbin plate 40 at mounting ring 32 to bobbin core 26.

Transformer assembly 20 further includes axle 50 passing through the hollow center of bobbin 28. Axle 50 includes four (4) axle bars 52, only two of which are shown, operably coupled to end axle plates 54 and 58, and center axle plate 56. Axle plates 54, 56, and 58 include axle plate cutouts 54A, 56A, and 58A (not shown), respectively, to allow rod 70 to pass from proximal end 24 to distal end 22.

Axle plate 54 receives four (4) stand offs 64, only two of which are shown, for mounting motor assembly 90 to transformer assembly 20. It will be appreciated that axle plate 54 may mount inside bobbin plate cutout 34 or axle plate 54 may mount directly to bobbin plate 30. Similarly, axle plate 58 may mount inside bobbin plate cutout 44 or axle plate 58 may mount directly to bobbin plate 40.

As shown in FIG. 2, spinning breakout assembly 80 includes electrode hub 82, electrode 84, and commutator interface 85. Electrode hub 82 operatively couples electrode 84 to rod 70. Toroidal capacitor 86 mounts to bobbin plate 40, proximate to electrode hub 82. The output of the secondary coil (not shown) of transformer assembly 20 couples to toroidal capacitor 86 and commutator interface 85, such that commutator interface 85 provides a discharge path from the resonant transformer secondary winding to electrode 84. Commutator interface 85 may include a brush or barring assembly to electrically conduct energy from the resonant transformer output to electrode 84. Commutator interface 85 may also comprise a spark gap, which conducts energy after a sufficient breakdown voltage is present at the output of toroidal capacitor 86. Energy is conducted via electrode 84 to a "break-out" or discharge point 88 creating a discharge spark 100 (shown in FIG. 4).

As shown in FIG. 3, motor assembly 90 includes motor 92 and motor coupler 94. Rod 70 passes through axle plate cutout 54A of axle plate 54 and bobbin plate 30 to couple to the shaft of motor 92 via coupler 94. Motor 92 mounts to axle plate 54 via stand offs 64. It will be understood that in some embodiments motor 92 may be directly mounted to bobbin plate 30.

In addition to the structural aspects of transformer assembly 20, materials used to manufacture assembly 20 are selected to minimize the risk of high voltage discharges being conducted into motor 92 or other portions of system 10. Illustratively, at least some components of axle 50, rod 70, and coupler 94 are non-conductive to prevent charge carried through breakout assembly 80 from discharging into motor assembly 90 or other portions of system 10.

As shown in FIG. 4, system 10 further includes arm assembly 200 and power generation and control system 210. Arm assembly 200 includes arm 201 having a neutralizing end 202, control end 204, and wiring harness 206 attached at intervals along arm 201. Resonance transformer assembly 220 is operably mounted to transformer end 202 to permit remote detonation of explosive devices away from power generation and control system 210. Power generation and control system 210 includes wiring harness 212, which attaches to wiring harness 206 along arm 201. Wire harness 212 couples system controls for motor 92 and power for transformer assembly 220.

In one embodiment, power generation and control system 210 operably controls the sweeping rate of electrode 84 by governing the rotation of motor 92. In another embodiment, not having a motor, rotation is provided by wings (not shown), which spin resonance transformer assembly 220 by an aerodynamic "wind-milling" effect as assembly 220 is moved, e.g., while being used when mounted to a vehicle. It will be understood that any number of electrodes may be provided (shown illustratively as electrodes 84A and 84B in FIG. 4). Illustratively, the aerodynamic wings are not conductive to reduce the risk of self arching. Likewise, at least some portion of arm assembly 200 may be non-conductive to reduce the possibility of inadvertent discharge back into power generation and control system 210.

As the motor of resonance transformer assembly 220 rotates electrodes 84A and 84B, high voltage discharges are emitted in a sparking pattern into the ground, thereby detonating any seen or unseen explosive device in the vicinity. In other instances, these electrical discharges may destroy any electronic equipment they either strike or which is disrupted by the resulting electrical field created by system 10.

The spinning emission point itself may be any form of conductive or semi-conductive rod from which lightning sparks can emit, of any length, set at any angle from the coil from which it emanates. The system to which the spinning emission point is attached can be any form of artificial lightning or electrical field generator including but not limited to a Marx Generator, Van De Graff machine, Tesla Coil, Odin Coil or any form of resonance transformer. The motor can be an air motor, electrical motor, hydraulic motor or any other form of motor capable of rotating the spinning emission point through a shaft. The motor can also be mounted in different locations with transformer assembly 20, and it can be operated by batteries or connected to other sources of power.

System 10 is designed to deliver a spark discharge to the explosive device or electronic device targeted, whether seen or unseen. In a system where a fixed "rake" or other emitter is employed, the distance of the electrode to the ground matters and a spark may possibly be drawn away from the intended device to be struck. The spinning emission point system of the disclosure allows for sparks to be rotated and, through forward motion of the system, therefore covers every area of ground with at least one spark, regardless of height of the electrode from the ground. The effect is comparable to a Spiro-graph when looked at from above. As the "circles" created by the spinning discharge points move forward, the lines of coverage cover a path wide enough for a spark to strike any device within the width from one concentric "circle" to the next, thereby effectively destroying or disabling the explosive or electronic device that is targeted or sought.

While the disclosure has been illustrated and described in detail in the drawings and foregoing description, the same is to be considered as illustrative and not restrictive in character, it being understood that only the preferred embodiment has been shown and described and that all changes and modifications that come within the spirit of the disclosure are desired to be protected.

What is claimed is:

1. A system for neutralizing an explosive device disposed within a targeted area, the system comprising:

an artificial lightning generator operable to generate at least one electric spark; and a spinning breakout apparatus in electrical communication with the artificial lightning generator, wherein the spinning breakout apparatus is operable to spin a spark emission point in a predetermined pattern within the targeted area, and wherein, for neutralizing the explosive device, the spinning breakout apparatus is further operable to discharge the at least one electric spark into the targeted area via the spark emission point.

2. The system of claim 1, wherein the spinning breakout apparatus includes:

an electrode defining the spark emission point; and a commutator interface electrically coupling the electrode and the artificial lightning generator, wherein the commutator interface is operable to provide a discharge path from the artificial lightning generator to the electrode.

3. The system of claim 1, wherein the artificial lightning generator includes a resonant transformer.

4. The system of claim 3, wherein the spinning breakout apparatus includes:

an electrode defining the spark emission point; and a commutator interface electrically coupling the electrode and the resonant transformer, wherein the commutator interface is operable to provide a discharge path from the resonant transformer to the electrode.

5. The system of claim 1, wherein the predetermined pattern is a circular pattern.

6. The system of claim 1, wherein at least a portion of the spinning breakout apparatus is in motion within the targeted area in concurrence with a spinning of the spark emission point in the predetermined pattern within the targeted area and a discharging of the at least one electric spark into the targeted area via the spark emission point.

7. The system of claim 1, further comprising:

a motor physically connected to the spinning breakout apparatus, wherein the motor is operable to control a spinning of the spark emission point in the predetermined pattern within the targeted area.

8. The system of claim 7, wherein the artificial lightning generator includes:

a hollow core; and a rod extending through the hollow core and physically coupling the motor to the spinning breakout apparatus.

9. The system of claim 1, further comprising:

a power generation and control system in electrical communication with the artificial lightning generator, wherein the power generation and control system is operable to supply power and control to the artificial lightning generator.

10. The system of claim 9, wherein the power generation and control system includes:

an arm having a neutralizing end and a control end, wherein the artificial lightning generator and the spinning breakout apparatus are mounted on the neutralizing end, and wherein the control end is spaced from the neutralizing end to facilitate a neutralization of the explosive device within the targeted area.

11. The system of claim 1, wherein the targeted area is an area of earth and the explosive device is disposed in the area of earth.

12. A system for neutralizing an explosive device disposed within a targeted area, the system comprising:

a resonant transformer operable to generate at least one electric spark; and a spinning breakout apparatus including an electrode in electrical communication with the resonant transformer, wherein the spinning breakout apparatus is operable to spin the electrode in a predetermined pattern within the targeted area, and wherein, for neutralizing the explosive device, the spinning breakout apparatus is further operable to discharge the at least one electric spark into the targeted area via the electrode.

13. The system of claim 12, wherein the predetermined pattern is a circular pattern.

14. The system of claim 12, wherein at least a portion of the spinning breakout apparatus is in motion within the targeted area in concurrence with a spinning of the electrode in the predetermined pattern within the targeted area and a discharging of the at least one electric spark into the targeted area via the electrode.

15. The system of claim 12, further comprising:

a motor physically connected to the spinning breakout apparatus, wherein the motor is operable to control a spinning of the spark emission point in the predetermined pattern within the targeted area.

16. The system of claim 15, wherein the artificial lightning generator includes:

a hollow core; and a rod extending through the hollow core and physically coupling the motor to the spinning breakout apparatus.

17. The system of claim 12, further comprising:

a power generation and control system in electrical communication with the artificial lightning generator, wherein the power generation and control system is operable to supply power and control to the artificial lightning generator.

18. The system of claim 17, wherein the power generation and control system includes:

an arm having a neutralizing end and a control end, wherein the artificial lightning generator and the spinning breakout apparatus are mounted on the neutralizing end, and wherein the control end is spaced from the neutralizing end to facilitate a neutralization of the explosive device within the targeted area.

19. The system of claim 12, wherein the targeted area is an area of earth and the explosive device is disposed in the area of earth.

20. The system of claim 12, wherein the electrode comprises a rod having an end that defines a spark emission point that is spun by the spinning breakout apparatus in the predetermined pattern.

* * * * *